US008932082B2

(12) United States Patent
Yu et al.

(10) Patent No.: US 8,932,082 B2
(45) Date of Patent: Jan. 13, 2015

(54) ELECTRICAL CONNECTOR WITH IMPROVED RETENTION STRUCTURE

(71) Applicant: Alltop Electronics (Suzhou), Ltd., Taicang, JiangSu (CN)

(72) Inventors: Wang-I Yu, Jhonghe (TW); Hung-Chi Tai, Jhonghe (TW); Yung-Chih Hung, Jhonghe (TW); Kuo-Cheng Liu, Jhonghe (TW)

(73) Assignee: Alltop Electronics (Suzhou) Ltd., Taicang (CN)

( * ) Notice: Subject to any disclaimer, the term of this patent is extended or adjusted under 35 U.S.C. 154(b) by 94 days.

(21) Appl. No.: 13/750,189

(22) Filed: Jan. 25, 2013

(65) Prior Publication Data

US 2014/0127945 A1 May 8, 2014

(30) Foreign Application Priority Data

Nov. 8, 2012 (CN) ..... 2012 1 0442827

(51) Int. Cl.
*H01R 24/00* (2011.01)
*H01R 12/72* (2011.01)
*H01R 13/428* (2006.01)

(52) U.S. Cl.
CPC ..... *H01R 12/724* (2013.01); *H01R 13/428* (2013.01)
USPC ..... 439/626; 439/79

(58) Field of Classification Search
USPC ..... 439/626, 79, 660, 485, 290
See application file for complete search history.

(56) References Cited

U.S. PATENT DOCUMENTS

| | | | | |
|---|---|---|---|---|
| 5,667,392 | A * | 9/1997 | Kocher et al. | 439/79 |
| 6,394,818 | B1 * | 5/2002 | Smalley, Jr. | 439/79 |
| 7,425,145 | B2 * | 9/2008 | Ngo | 439/290 |
| 7,458,839 | B2 * | 12/2008 | Ngo et al. | 439/291 |
| 7,726,982 | B2 * | 6/2010 | Ngo | 439/79 |
| 7,775,822 | B2 * | 8/2010 | Ngo et al. | 439/290 |
| 7,976,317 | B2 * | 7/2011 | Patel et al. | 439/79 |
| 7,980,860 | B2 * | 7/2011 | Yu et al. | 439/65 |
| 8,262,395 | B2 * | 9/2012 | Ke et al. | 439/79 |
| 8,419,482 | B1 * | 4/2013 | Yu et al. | 439/682 |
| 8,662,923 | B2 * | 3/2014 | Wu | 439/595 |
| 2013/0095693 | A1 * | 4/2013 | Yu et al. | 439/485 |
| 2014/0127949 | A1 * | 5/2014 | Yu | 439/660 |

* cited by examiner

*Primary Examiner* — Hae Moon Hyeon
(74) *Attorney, Agent, or Firm* — Sughrue Mion, PLLC

(57) ABSTRACT

An electrical connector mountable on a printed circuit board includes an insulative housing and pairs of power contacts. Each power contact has a contacting portion, a tail portion and an intermediate portion interconnecting the contacting portion and the tail portion. The intermediate portion is provided with a retention element in a rear edge thereof extending towards an inside wall of a passageway defined through the insulative housing. Each inside wall of the passageway forms a bump thereon extending along an insertion direction of a complementary connector. The retention element rides on the bump to thereby prevent an involuntarily anti-clockwise movement of the insulative housing with respect to the printed circuit board.

12 Claims, 7 Drawing Sheets

ELECTRICAL CONNECTOR WITH IMPROVED RETENTION STRUCTURE

BACKGROUND OF THE INVENTION

1. Field of the Invention

The present invention relates to an electrical connector, and more particularly, to an electrical connector with an improved retention structure.

2. Description of Related Art

Conventional electrical connector usually includes an insulative housing and a plurality of contacts received in the insulative housing. During assembly and in use, the contact is subject to an occasional/undesired displacement with respect to the insulative housing. Meanwhile, if the electrical connector is soldered to a printed circuit board, the insulative housing may involuntarily be adjusted with respect to the printed circuit board, which in turn influences the signal/power transmission quality.

Hence, an electrical connector with improved retention structure is desired.

BRIEF SUMMARY OF THE INVENTION

The present invention provides an electrical connector mountable on a printed circuit board and adapted for mating with a complementary connector. The electrical connector comprises an insulative housing and pairs of power contacts received in the insulative housing. Each power contact comprises a contacting portion, a tail portion and an intermediate portion interconnecting the contacting portion and the tail portion. The intermediate portion is provided with a retention element in a rear edge thereof extending towards an inside wall of a passageway defined through the insulative housing. Each inside wall of the passageway forms a bump thereon extending along an insertion direction of the complementary connector. The retention element rides on the bump to thereby prevent an undesired counterclockwise movement of the insulative housing with respect to the printed circuit board.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENTS

Figure 1:
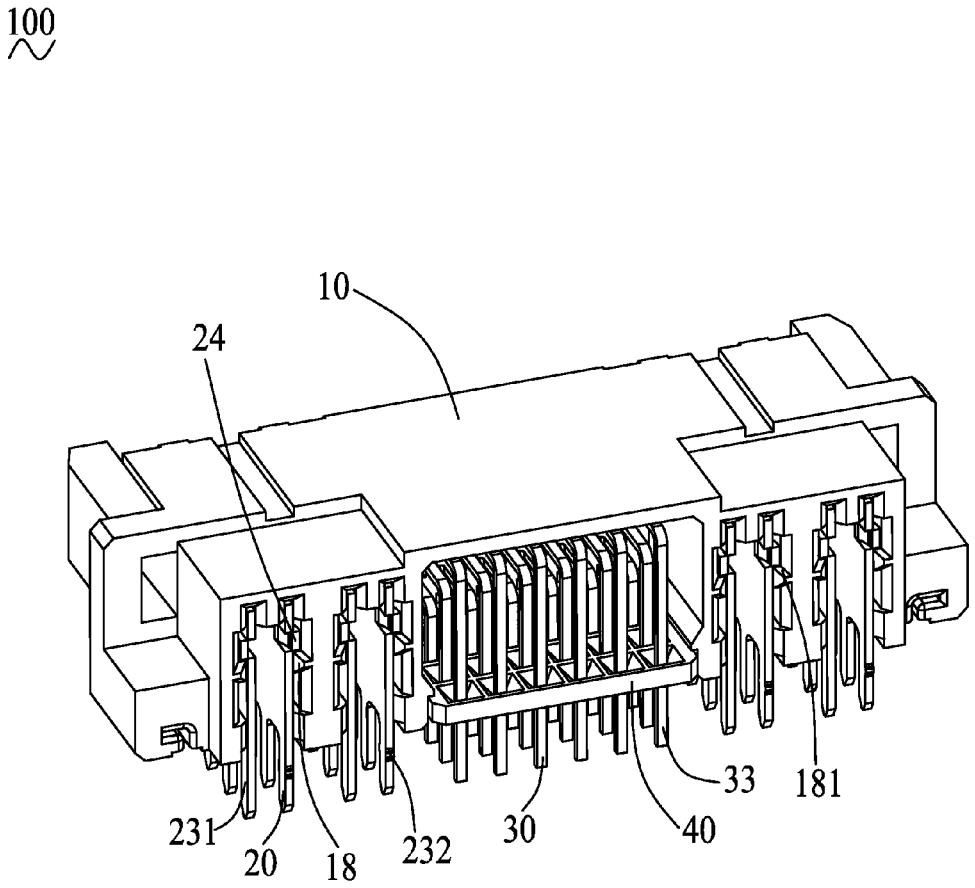
FIG. 1 is a perspective view of an electrical connector in accordance with the present invention.

Reference will now be made to the drawing figures to describe the embodiments of the present invention in detail. In the following description, the same drawing reference numerals are used for the same elements in different drawings.

Figure 2:
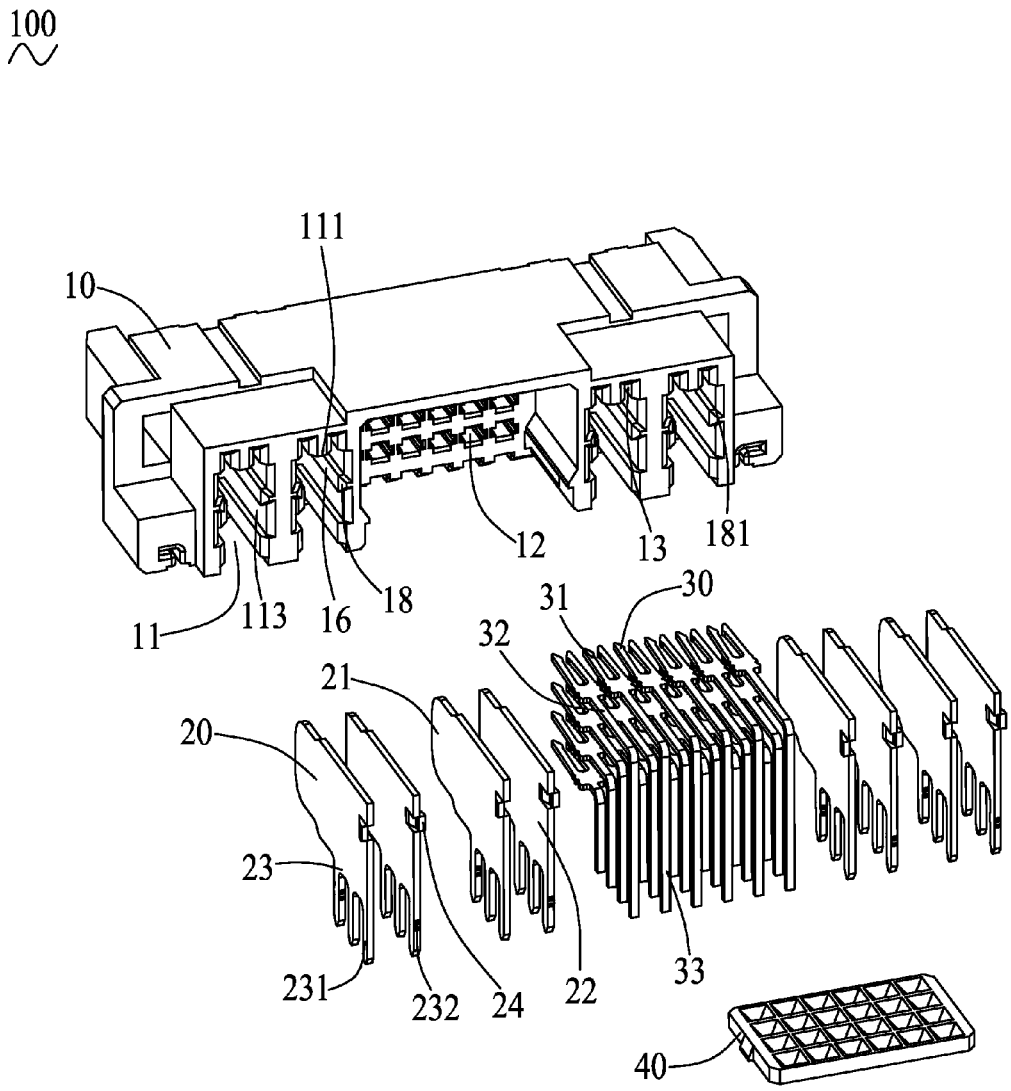
FIG. 2 is an exploded, perspective view of the electrical connector as shown in FIG. 1.

Referring to FIGS. 1 and 2, the present invention discloses an electrical connector 100 mountable on a printed circuit board and matable with a complementary connector (not shown). The electrical connector 100 includes an insulative housing 10, pairs of power contacts 20 and a plurality of signal terminals 30 retained in the insulative housing 10.

Figure 3:
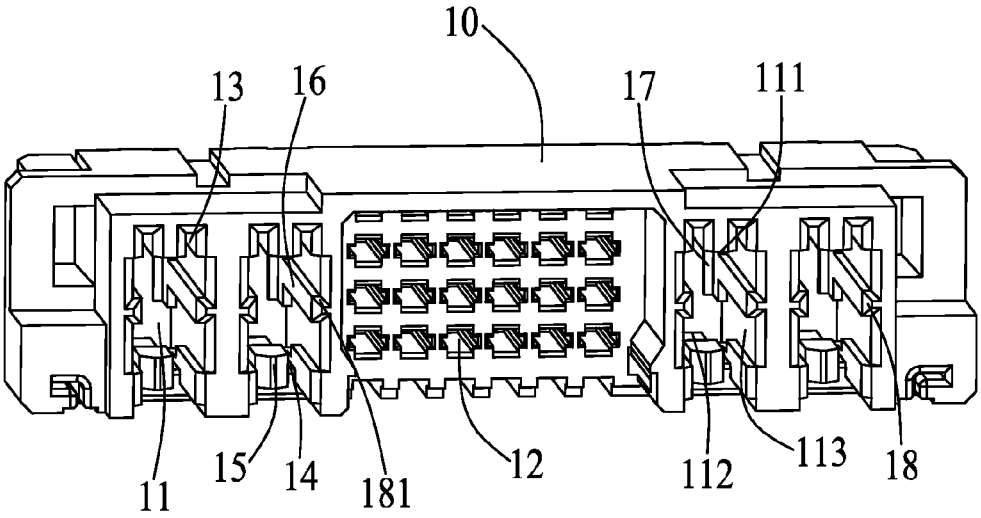
FIG. 3 is a perspective view of an insulative housing as shown in FIG. 2.
Figure 4:
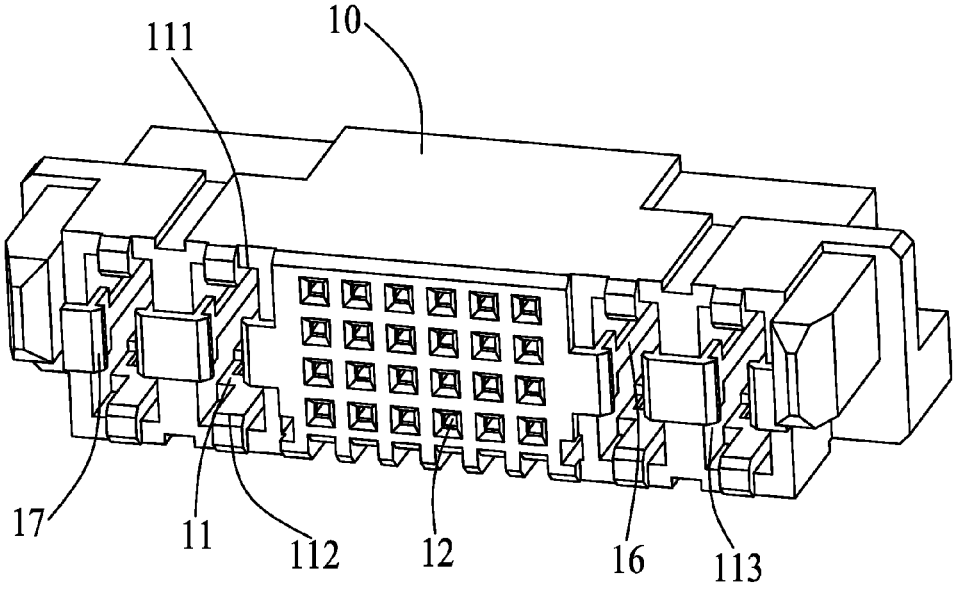
FIG. 4 is a perspective view of the insulative housing as shown in FIG. 3 while taken from another aspect.

Referring to FIGS. 3 and 4 together with FIG. 2, the insulative housing 10 provides a plurality of passageways 11 for receiving corresponding pair of power contacts 20 and a plurality of cavities 12 for receiving corresponding signal terminals. Each passageway 11 includes a top inside wall 111, a bottom inside wall 112 and two side inside walls 113 connecting the top inside wall 111 and the bottom inside wall 112. Each passageway 11 defines a pair of upper channels 13 recessed from the top inside wall 111 and a pair of lower channels 14 opposite to the upper channels 13 recessed from the bottom inside wall 112. The passageway 11 also provides an isolating block 15 located between the pair of lower channels 14 which are adapted for isolating the pair of power contacts 20 received therein from each other and limiting a transversal displacement of the pair of power contacts 20. A stopper 17 is formed in the front of the passageway 11 for blocking an occasional forwarding movement of the power contact 20. A guiding projection 18 is formed in the rear of the passageway 11 and has a guiding surface 181 formed thereon for guiding an insertion of corresponding power contact 20.

Each side inside wall 113 of the passageway 11 has a bump 16 protruded therefrom and extending along an insertion direction of the complementary connector. In the preferred embodiment, the bump 16 connects and extends between the stopper 17 and the guiding projection 18.

Figure 5:
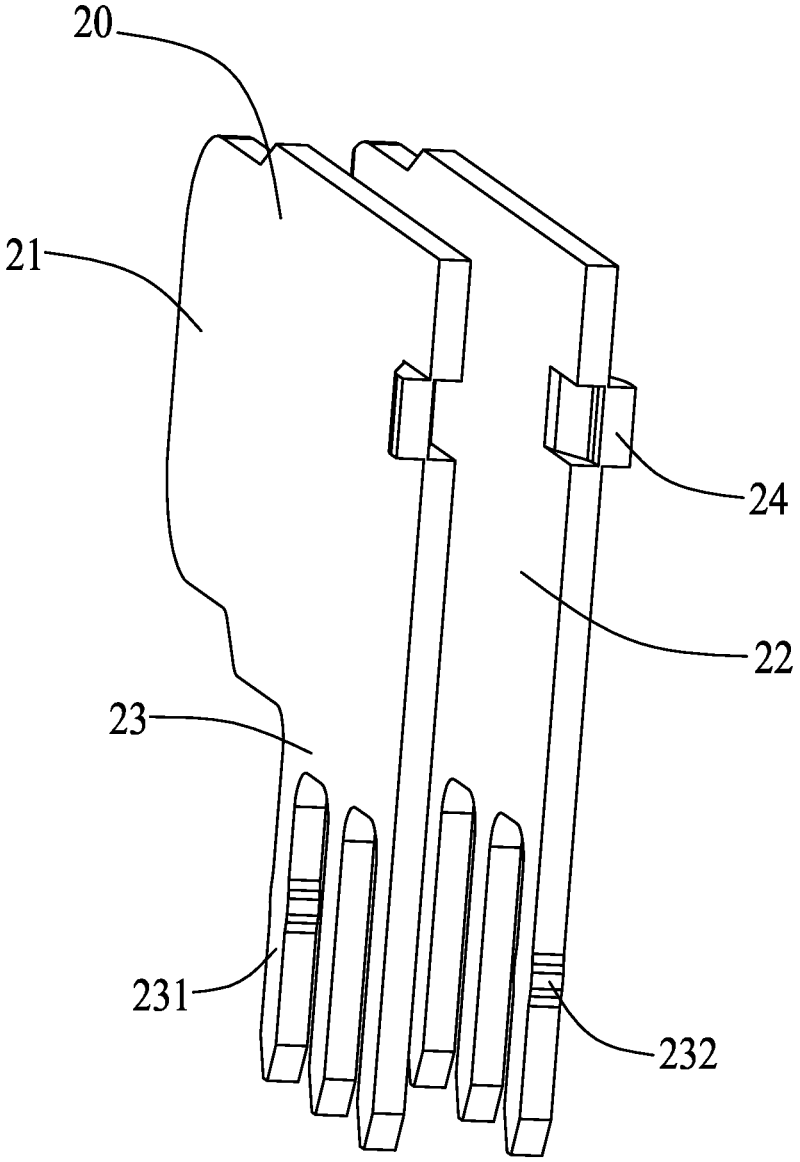
FIG. 5 is a perspective view of a pair of power contacts as shown in FIG. 2.
Figure 6:
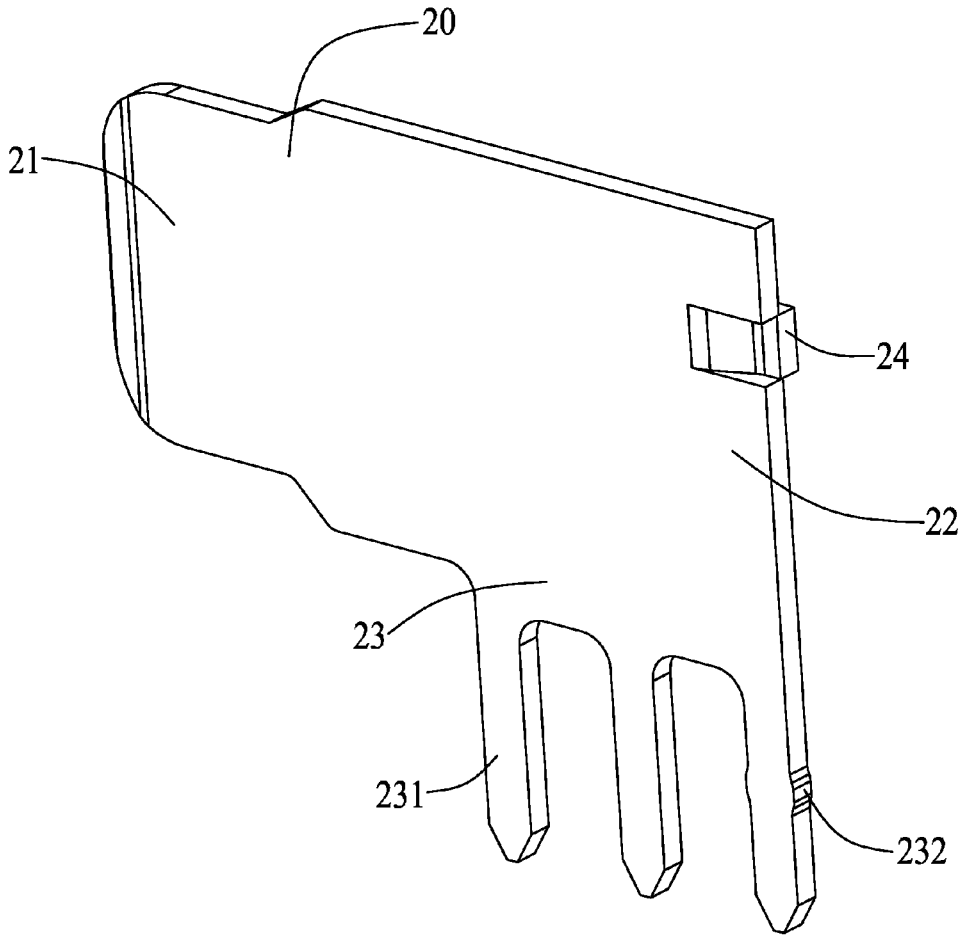
FIG. 6 is a perspective view of one power contact as shown in FIG. 5.

Referring to FIGS. 5 and 6 together with FIGS. 2 and 3, each pair of power contacts 20 includes two separated, opposed power contacts 20. The power contacts 20 are parallel to each other and are configured in a planar shape. Each power contact 20 comprises a contacting portion 21, a tail portion 23, and an intermediate portion 22 interconnecting the contacting portion 21 and the tail portion 23. The contacting portion 21 and the intermediate portion 22 are configured to be coplanar with each other. The tail portion 23 extends perpendicularly to the contacting portion 21. The upper channels 13 are configured to retain therein the upper sides of the intermediate portion 22 of the power contacts 20 and the lower channels 14 are configured to retain therein the lower sides of the intermediate portion 22 of the power contacts 20.

A retention structure or a retention element 24 is provided in the present invention in a form of a resilient tab 24 which extends from a rear edge of the intermediate portion 22 towards the side inside wall 113 of the passageway 11. The resilient tab 24 has a cantilevered end projecting out from the intermediate portion 22 and extending along a direction away from the contacting portion 21 of the power contact 20. In the preferred embodiment, the resilient tab 24 of the power contact 20 rides on the bump 16 of the passageway 11 to thereby prevent an undesired counterclockwise movement of the insulative housing 10 with respect to the printed circuit board.

Besides, a heat dissipation path is formed between the power contact 20 and the side inside wall 113 when the resilient tab 24 of the power contact 20 abuts against the bump 16.

The tail portion 23 of the power contact 20 includes a plurality of solder tails 231 extending perpendicularly to the contacting portion 21 and towards the printed circuit board. Each pair of power contacts 20 defines two rows of solder tails 231 therewith. Protrusions 232 (FIG. 5) are provided on some solder tails 231 to facilitate the securation of the power contact 20 in the proper position. In the preferred embodiment, the tail portion 23 has three solder tails 231 which are aligned with each other along the insertion direction of the complementary connector. One protrusion 232 is formed on a forwardest solder tail 231 of one of the pair of power contacts 20 and one protrusion 232 is formed on a last solder tail 231 of the other one of the same pair of power contacts 20. Such an arrangement limits an undesired displacement of the electrical connector 100 with respect to the printed circuit board.

Figure 7:
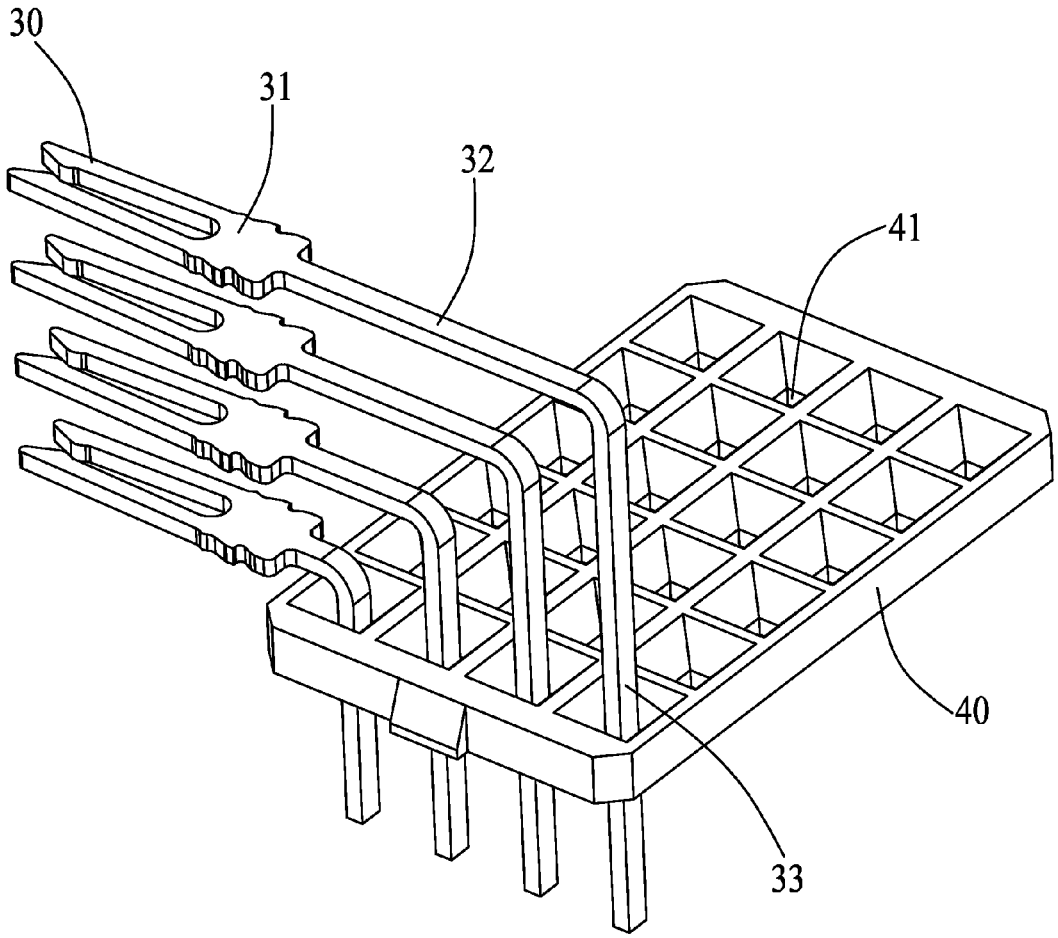
FIG. 7 is a partially assembled, perspective view of a plurality of signal terminals and a spacer as shown in FIG. 2.

Referring to FIGS. 2 and 7, the plurality of signal terminals 30 are divided into six groups. Each group of signal terminals 30 has four signal terminals which has similar structures and are different in sizes. Each signal terminal 30 includes a planar base section 32, a contacting section 31 extending from an edge of the planar base section 32 and a tail section 33 extending from an opposite edge of the planar base section 32. The tail section 33 is bent to perpendicular to the contacting section 31. The cavities 12 of the insulative housing 10 are arranged in columns and rows to receive corresponding signal terminals 30. In the preferred embodiment, the signal terminals 30 are located between the pairs of power contacts 20. Each contacting section 31 of the signal terminal 30 extends in a horizontal plane. Each power contact 20 extends in a plane perpendicular to the contacting section 31 of the signal terminal 30.

The electrical connector 100 also includes a spacer 40 having a plurality of holes 41 for guiding and positioning the tail sections 33 of the signal terminals 30.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

We claim:

1. An electrical connector mountable on a printed circuit board and adaptable for mating with a complementary connector, comprising:

an insulative housing defining a plurality of passageways extending therethrough, wherein each passageway is defined by a plurality of inside walls; and a plurality of pairs of power contacts, wherein each pair of power contacts is received in corresponding passageway of the insulative housing, each pair of power contacts including two separate, opposed power contacts, each power contact comprising a contacting portion, a tail portion and an intermediate portion interconnecting the contacting portion and the tail portion, the intermediate portion provides a retention element in a rear edge thereof extending towards the inside wall of the passageway;

wherein each inside wall of the passageway forms a bump thereon extending along an insertion direction of the complementary connector;

wherein the retention element abuts against on the bump to thereby prevent an involuntarily anti-clockwise movement of the insulative housing with respect to the printed circuit board;

wherein the retention element is formed as a resilient tab having a cantilevered end projecting out from the intermediate portion and extending along a direction away from the contacting portion of the power contact;

wherein the inside walls of each passageway comprises a top inside wall, a bottom inside wall and two opposing side inside walls connecting with the top inside wall and the bottom inside wall, and wherein the bump is formed on each of the side inside walls;

wherein each passageway defines a pair of upper channels recessed from the top inside wall and a pair of lower channels recessed from the bottom inside wall.

2. The electrical connector as claimed in claim 1, wherein the upper channel receives corresponding upper edge of the intermediate portion of each power contact and the lower channel receives corresponding lower edge of the intermediate portion of each power contact.

3. The electrical connector as claimed in claim 2, wherein the passageway provides an isolating block between the pair of lower channels which isolates the pair of power contacts from each other and limits a transversal displacement of the pair of power contacts.

4. The electrical connector as claimed in claim 1, wherein the bump is protruded from the side inside wall and wherein a heat dissipation path is formed between the power contact and the side inside wall when the resilient tab of the power contact abuts against the bump.

5. The electrical connector as claimed in claim 4, wherein a guiding projection is formed at a rear side of the side inside wall and wherein the guiding projection connects to the bump and forms a guiding surface thereof for guiding an insertion of the power contact into the passageway during assembly.

6. The electrical connector as claimed in claim 5, further comprising a plurality of signal terminals received in the insulative housing and located between the pairs of power contacts, wherein each signal terminal comprising a contact section extending in a horizontal plane and a tail section vertically bending from the contact section.

7. The electrical connector as claimed in claim 6, wherein each power contact is formed in a coplanar type and extends in a plane perpendicular to the contact section of the signal terminal.

8. The electrical connector as claimed in claim 7, wherein the insulative housing defines columns and rows of cavities extending along the insertion direction of the complementary connector for receiving corresponding signal terminals.

9. The electrical connector as claimed in claim 8, further comprising a spacer which defines a plurality of holes for positioning and receiving the tail sections of the signal terminals.

10. The electrical connector as claimed in claim 9, wherein each passageway defines a stopper in the front thereof for blocking an occasional forwarding movement of each power contact.

11. The electrical connector as claimed in claim 10, wherein the bump connects and extends between the stopper and the guiding projection.

12. An electrical connector mountable on a printed circuit board and adapted for mating with a complementary connector, comprising:

an insulating housing defining a plurality of passageways extending therethrough, each passageway having inside walls; and pairs of power contacts received in corresponding passageway of the insulating housing, each pair of power contacts including two separate, opposed power contacts, each power contact comprising a contacting portion, a tail portion and an intermediate portion interconnecting the contacting portion and the tail portion, the intermediate portion providing a retention element in a rear edge thereof extending towards the inside wall of the passageway; wherein each inside wall of the passageway forms a bump thereon extending along an insertion direction of the complementary connector; wherein the retention element rides on the bump to thereby prevent an undesired counterclockwise movement of the insulating housing with respect to the printed circuit board;

wherein the retention element is formed as a resilient tab having a cantilevered end projecting out from the intermediate portion and extending along a direction away from the contacting portion of the power contact;

wherein the inside walls of each passageway comprises a top inside wall, a bottom inside wall and two opposing side inside walls connecting with the top inside wall and the bottom inside wall, and wherein the bump is formed on each of the side inside walls;

wherein the bump is protruded from the side inside wall and wherein a heat dissipation path is formed between the power contact and the side inside wall when the resilient tab of the power contact abuts against the bump.

* * * * *